US006274987B1

(12) United States Patent
Burke

(10) Patent No.: US 6,274,987 B1
(45) **Date of Patent: *Aug. 14, 2001**

(54) POWER SENSING LAMP PROTECTION CIRCUIT FOR BALLASTS DRIVING GAS DISCHARGE LAMPS

(75) Inventor: Robert V. Burke, Fort Wayne, IN (US)

(73) Assignee: MagneTek, Inc., Los Angeles, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/646,470

(22) Filed: May 8, 1996

(51) Int. Cl.[7] ..... H05B 37/02

(52) U.S. Cl. ..... 315/307; 315/360; 315/225; 315/DIG. 5; 315/247

(58) Field of Search ..... 315/209 R, 307, 315/247, DIG. 7, 219, 224, 291, 225, 289, 290, DIG. 5, 360

(56) References Cited

U.S. PATENT DOCUMENTS

| | | | | |
|---|---|---|---|---|
| Re. 32,901 | | 4/1989 | Nilssen | 315/244 |
| Re. 32,953 | | 6/1989 | Nilssen | 315/224 |
| 4,503,363 | | 3/1985 | Nilssen | 315/225 |
| 4,667,131 | | 5/1987 | Nilssen | 315/275 |
| 5,004,955 | | 4/1991 | Nilssen | 315/119 |
| 5,363,020 | * | 11/1994 | Chen et al. | 315/209 R |
| 5,434,474 | * | 7/1995 | Ukita et al. | 315/128 |
| 5,436,529 | | 7/1995 | Bobel | 315/127 |
| 5,623,187 | * | 4/1997 | Caldeira et al. | 315/307 |

* cited by examiner

*Primary Examiner*—Arnold Kinkead
(74) *Attorney, Agent, or Firm*—Mark J. Patterson; Waddey & Patterson

(57) ABSTRACT

A lamp protection circuit for smaller gas discharge lamps and for compact fluorescent lamps powered by a ballast. The circuit protects against several lamp failure modes that can cause overheating and cracking of the lamp. Power levels in the lamp are sensed and when a level is exceeded, a control signal is generated. The circuit acts to reduce power in an electronic ballast powering the lamp and keeps the lamp powered down when either one of two fault conditions is sensed in the lamp. Several embodiments are disclosed.

19 Claims, 5 Drawing Sheets

POWER SENSING LAMP PROTECTION CIRCUIT FOR BALLASTS DRIVING GAS DISCHARGE LAMPS

BACKGROUND OF THE INVENTION

This invention relates to a protection circuit for smaller diameter gas discharge lamps and for compact fluorescent tube designs in particular. The device acts to reduce power in an electronic ballast and keeps the power at a low level when sensing a fault condition occurring in the lamp.

As fluorescent lamps age, the emissive material is worn away so that any arc current must flow from the bare tungsten filament. The work functions of the tungsten filament is high, therefore the filament is quickly melted. If the voltage supplied by the ballast is high enough, the lamp can be started with a broken or missing filament. After the filament has evaporated, the lamp arc current can flow from one of the filament support wires. These wires also have a high work function and considerable heat is generated when arc current flows from one of them. In some cases the heat is high enough to crack or melt the glass wall of the lamp. Overheating is a particular problem with small diameter lamp tubes and compact fluorescent lamps especially toward the end of the lamp's life. In a compact fluorescent lamp both ends of the lamp are adjacent to each other and are encased in a plastic housing. The base of the lamps are mounted in a plastic housing to which either a connector or a ballast is attached. When the lamps overheat, the hot glass can cause the plastic to deform. The glass can reach temperatures of over 350 degrees Celsius on the outer surface during abnormal lamp operating modes. It is possible that operation at these high temperatures will cause the glass wall to crack. It is desirable for the ballast, when operating, to be able to reliably control all lamp operating modes, so that abnormal lamp failure modes are not permitted to develop.

Three test schemes have been proposed as an IEC standard by Osram Sylvania; first, a test for maximum current heating in the electrodes, second, a test for lamp overvoltage or voltage rise and third, a test for lamp rectification. Designing a cost effective and manufacturable circuit to perform these tests is challenging. Various shutdown sensing and control circuit schemes are possible. One method is to sense when the lamp voltage rises above a setpoint while the lamp arc is ignited and then issue a shutdown or power reduction command to shut down the supply of power from the ballast to the lamp. A second possible solution is to sense when the output power rises above a control setpoint and then issue a command to reduce the supply of power from the ballast to the lamp. A third possible solution is to sense the filament current level when the filament voltage is present and issue a command if the filament current does not flow or has a zero value. Each of these solutions pose a challenge to the circuit designer. It is difficult to build a circuit that does not suffer from being complicated to build, and degrading the reliability of the ballast system by adding additional components that are subject to failure.

Once the ballast power is reduced to a safe level, the circuit needs to be able to perform two functions. First, it needs to be able to sense when a lamp is behaving abnormally and automatically resume normal operation when the failed lamp is replaced. The second function of a shutdown circuit could be described as limiting the periodic attempts at restarting until the lamp is replaced to minimize annoying blinking of the lamps until they are replaced. Another solution for this function, would be for the ballast to sense proper lamp operation and resume normal operations without input voltage reset or lamp blinking. The circuits could be designed to allow resetting only when power is first removed and then reapplied to the ballast. This would work in some applications, but not in others where the lamp fixture is normally continuously powered.

Prior attempts at gas discharge lamp ballasts with shutdown circuits have resulted in implementations with various drawbacks. Such implementations are illustrated by U.S. Pat. No. RE 32,901, RE 32,953, and 5,004,955. These show ballast shutdown circuits that sense an overvoltage condition in the resonant output circuit. They require a voltage clamp (varistor) to activate before the shutdown circuit can be activated. Its purpose is to prevent a shock hazard at the output terminals and not to protect the lamp. This approach has several draw backs, first two of the abnormal lamp failure modes may not be detected. The missing filament and asymmetrical operation. Second, these circuits require turning the power off and on after a new lamp is installed before the lamps will strike. For many large fixture installations on one circuit this is not feasible. U.S. Pat. 4,667,131, and 4,503,363 disclose shock protection circuits that have a two stage turn off. They use a high voltage SCR and a transistor to disable the inverter. These additional and high voltage parts add additional cost to the circuit. These circuits will not detect asymmetrical operation of the lamp. U.S. Pat. 5,436,529 shows a circuit that disables an inverter in response to an overvoltage condition occurring at the lamp. Once turned off, it stays off until the defective lamp is replaced and then automatically restarts. It requires extra components such as DC blocking capacitors to allow the circuit to sense a broken filament and turn-off.

These prior art circuits require a large component count and their associated complexity. The prior art shutdown and lamp protection circuits are all directed toward series-resonant non-isolated ballast designs that do not have an isolation transformer between the lamp and the circuit. It is advantageous to be able to have a lamp protection circuit that operates with a parallel resonant isolated ballast. This is the preferred ballast and lamp configuration in the industry.

A currently unmet need exists for a simple circuit to work with electronic ballasts that are of a parallel resonant design with an isolation transformer to protect small diameter gas discharge lamps and compact fluorescent lamps from overheating and cracking.

SUMMARY

An object of the invention is to provide a lamp protection circuit for smaller diameter gas discharge lamps such as compact fluorescent lamps including both isolated and non-isolated ballast circuits. The protection circuit protects against several lamp failure modes that can cause filament overheating and cracking of the lamp.

Another object of the invention is to provide a lamp protection circuit that detects a lamp overvoltage condition and a lamp rectification condition.

Another object of the invention is to allow a protection circuit design that may include automatic restarting after a defective lamp is replaced.

Another object of the invention is to provide a protection circuit that is simple, easily fabricated, low in parts count and cost, light weight and reliable.

A protection circuit for at least one gas discharge lamp. The protection circuit senses several failure modes in the lamp and provides a control signal to a ballast circuit powering the lamp to reduce power being supplied to the lamp to prevent overheating of the lamp. The circuit includes a sensor means for detecting the lamp failure mode. The sensor means providing a sensor signal proportional to the lamp power. A control means is coupled to the sensor means. The control means has a control input terminal for receiving the sensor signal and a control output terminal. The control means provides the control signal at the output terminal in response to the sensor means. A boost converter is connected to the control means output terminal. The control means provides the control signal to the boost converter such that power to the lamp is reduced. A time delay means is also a feature of the protection circuit. The time delay means is connected to the control means such that the control means is unresponsive to a transient overvoltage prior to detecting the failure mode.

BRIEF DESCRIPTION OF THE DRAWINGS

These and other features, aspects and advantages of the present invention will become better understood with regard to the following description, appended claims and accompanying drawings where:

DETAILED DESCRIPTION OF THE PREFERRED EMBODIMENTS

Figure 1:
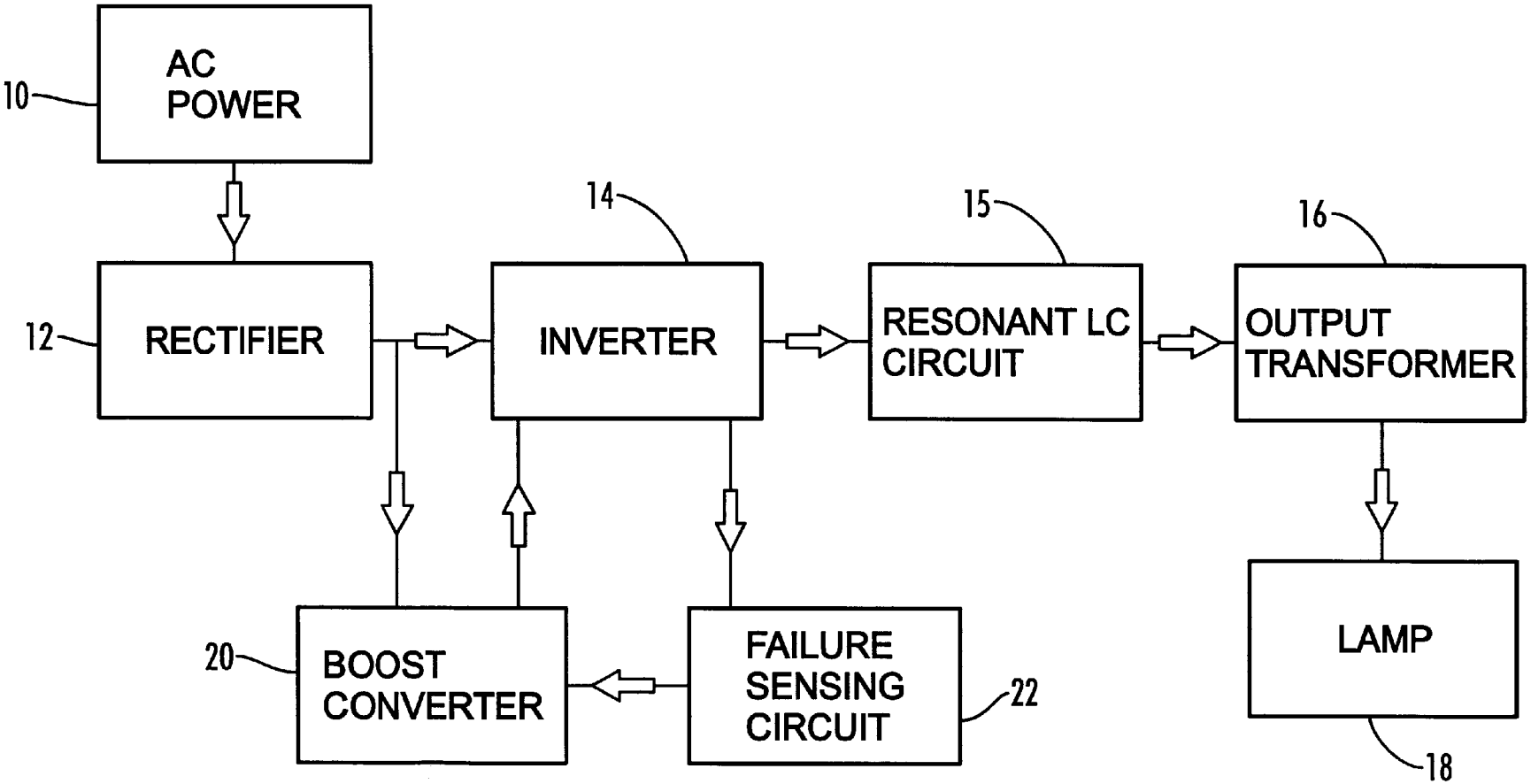
FIG. 1 is a block diagram of a Lamp Protection Circuit for Isolated Ballasts Driving Gas Discharge Lamps.

Referring to FIG. 1, a block diagram of a ballast and a lamp protection circuit of the invention is shown. A rectifier 12 receives low frequency AC power 10 and converts it into a pulsed DC voltage. The rectifier output is fed into a boost converter 20 and an inverter 14. The boost converter 20 increases the DC voltage above the magnitude of the AC line voltage and achieves power factor correction. This increased voltage is called the DC bulk voltage. The boost converter is used to generate a higher output voltage while controlling the rectifier input current waveshape to achieve unity power factor with the current at a low distortion. An inverter circuit 14 converts the DC signal to a high frequency AC signal on the order of 30 Kilohertz which drives a load. In this case, the load of interest is a gas discharge lamp such as lamp 18. A resonant LC circuit 15 provides a limited sine wave voltage. The lamp may be electrically isolated from the rest of the circuit for shock hazard and safety reasons by output transformer 16. It is also possible to omit the isolation transformer and use other means for shock protection. A lamp protection circuit would also work with these ballast designs.

The failure sensing circuit 22 is connected to the inverter 14. Circuit 22 senses the power level drawn by the lamp. This power level is reflected back into the inverter or the primary of the output transformer as the voltage and current product. Upon sensing the failure modes it issues a control signal to the boost converter. The control signal turns off the converter. This causes the magnitude of the DC bulk voltage to fall and conversely causes the magnitude of the high frequency AC voltage from the inverter to fall. The lower voltage transmitted through the output transformer to the lamp is then not of sufficient magnitude to cause the defective lamp to overheat. In some instances, the electric arc in the lamp will be extinguished depending upon the lamp condition. The protection circuit may be designed to periodically allow the converter to cycle in a restart attempt. In other instances, the power to the lamp is limited, until the lamp becomes deactivated.

The circuit could also be utilized to regulate the maximum output power level to a desired value, if so chosen. Preferably, the failure sensing circuit along with the boost converter, rectifier, inverter and output transformer would be manufactured as an integrated assembly.

Figure 2:
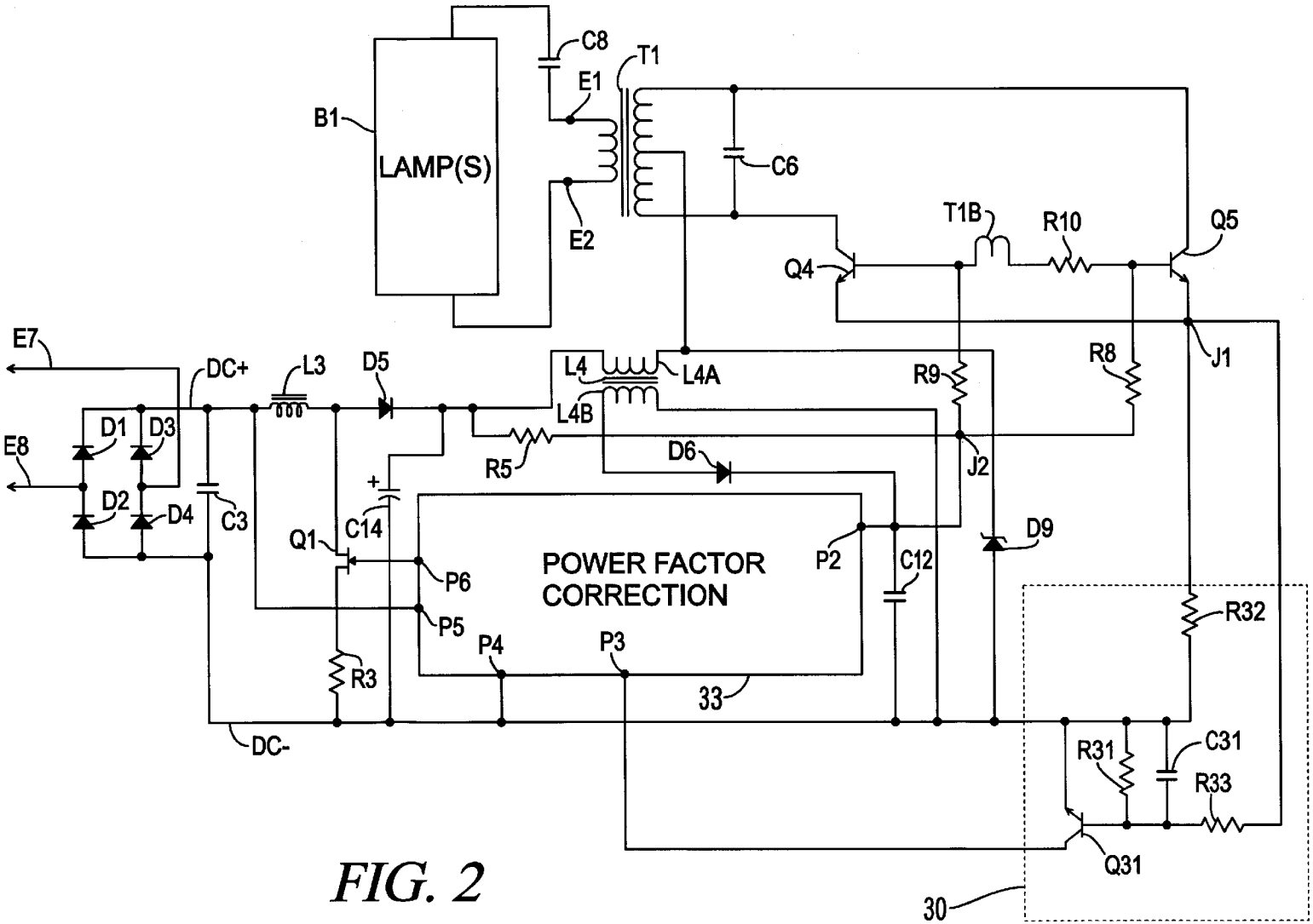
FIG. 2 is a schematic diagram of a preferred embodiment of a Primary Side Lamp Protection Circuit for Isolated Ballasts Driving Gas Discharge Lamps.

Referring now to FIG. 2, a detailed schematic of a ballast and the protection circuit is shown. In the circuit of FIG. 2, input terminals E7 and E8 are connected to a source of low frequency AC power. Diodes D1,D2,D3 and D4 such as a 1N4004 form a diode bridge which receives the AC power and provides an output of pulsed DC. A 0.1 microfarad capacitor C3 is connected across the output of the bridge. The diode bridge is connected with line DC+ and DC−. These carry the DC bulk voltage. Inductor L3 is located in series with a blocking diode D5. The Diode D5 utilized was a commmercially available UF4004. Connected between inductor L3 and diode D5 is the drain of a power factor correction switch (transistor) Q1 such as a IRF730. The source of Q1 is connected through a 0.47 ohm resistor R3 to the DC− line. Inductor L3, transistor Q1, diode D5, resistor R3, and circuit 33 form the boost converter. Inductor L3 stores energy which is periodically switched into the rest of the circuit by Q1. This increases the magnitude of the DC bulk voltage at C14 with respect to the DC− buss above the magnitude of the AC input voltage. Transistors Q4 and Q5 form a push-pull inverter for transforming the DC bulk voltage into a high frequency sine wave AC signal. Transistors such as Motorola XJE 18204 could be used for Q4 and Q5. A 330 K ohm resistor R5, a 1.6 K ohm resistor R9, a 1.6 K ohm resistor RS, a 1.5 ohm resistor R10, a diode D6, a capacitor C12, inductor L4 and transformer winding T1B form a biasing network for applying the proper voltages to the bases of transistors Q4 and Q5. The emitters of Q4 and Q5 are commoned at junction J1. Junction J1 is also known as inverter terminal J1. The collector of transistor Q4 is connected to one end of the primary of output transformer T1. The collector of transistor Q5 is connected to the other end of the primary of output transformer T1. A 1.8 nanofarad capacitor C6 is connected across the primary of T1. Inductor L4 has winding L4A connected between diode D5 and a center tap on the primary side of output transformer T1. Winding L4B is connected between diode D6 and the DC− line. Capacitor C12 is connected between diode D6 and the DC− line. A Diode D9 such as a SGS BZW06 is connected between inductor L4 and the DC− line. Diode D9 prevents excessive voltages from damaging transistors Q4 and Q5 when lamp B1 is removed from the circuit or when other damaging conditions may occur. The cathode of diode D9 is connected to inductor L4 and the anode of D9 is connected to the DC− line. A 47 microfarad electrolytic capacitor C14 is connected between the DC+ and DC− lines.

Power factor correction circuit 33 is connected to the protection circuit via terminals P2 through P6. Circuit 33, transistor Q1, inductor L3, diode DS and resistor R3 form the boost converter. Circuit 33 could be a power factor correction IC such as a Siemens 4817 or it could be a discrete implementation of such a device. Circuit 33 controls the power factor correction switch (transistor Q1) to generate a higher output voltage while controlling the rectifier input current waveshape to achieve unity power factor with the current at a low distortion. Terminal P2 is connected to the junction J2 of resistors R5,R8 and R9 for biasing purposes. Terminal P3 is connected to the collector of transistor Q31. Terminal P4 is connected to the DC− line. Terminal P5 is connected ahead of inductor L2. Terminal P6 is connected to the gate of power factor correction switch Q1. One or more lamp(s) B1 are disconnectedly connected through a 2.0 nanofarad capacitor C8 to output terminals E1 and E2 of the secondary of output transformer T1.

Protection circuit 30 contains a transistor Q31. Transistor Q31 can be a commercially available transistor such as a 2N4401. Circuit 30 also has a 10 K ohm resistor R33, a 3.9 ohm resistor R32, a 100 K ohm resistor R31 and a 4.7 microfarad capacitor C31. Resistor R32 is connected between the junction of the emitters of transistors Q4 and Q5 (junction J1) and the DC− line. Resistor R33 is connected between junction J1 and the base of transistor Q31. The collector of transistor Q31 is connected to terminal P3 of power factor correction circuit 33. The emitter of transistor Q31 is connected to the DC− line. Capacitor C31 is connected between the base of transistor Q31 and the DC− line. Resistor R31 is connected between the DC− line and the base of Q31.

The operation of the protection circuit of FIG. 2 is as follows. The protection circuit 30 will sense the lamp overvoltage failure mode and the rectifying lamp failure mode. The first condition sensed is when the lamp voltage rises above a setpoint while the lamp arc is ignited. If the lamp voltage rises by about 20 percent, then the lamp power will rise by about 20 percent. The power level on the primary winding of transformer T1 is proportional to the output power appearing at the lamp. Since the ballasting capacitor C8 delivers an approximately constant current to the load, any increase in load voltage will result in an increase in load power. The load power will be reflected across the primary of T1. Similarly, the primary voltage of T1 is fixed by the magnitude of the DC voltage across the bulk capacitor C14. Therefore, an increase in load power will result in an increase in current drawn by transistors Q4 and Q5. The voltage at the junction J1 of the emitters of transistor Q4 and Q5 with respect to the DC− buss will be proportional to the reflected power from the lamp with a constant bulk voltage. Resistor R32 acts as a sensor means to sense this current and outputs a sensor signal. Adjusting the value of resistor R32 changes the threshold value that indicates an overvoltage condition in the lamp which is indicative of an abnormal operating mode. Alternatively, the power level could be sensed directly from the primary winding of T1. When the voltage at J1 goes high, resistor R32 will cause transistor Q31 to be properly biased to turn on. Here transistor Q31 along with its biasing elements is the control means with its control input terminal being the base and its control output terminal being the collector. When transistor Q31 turns on, terminal P3 of the converter will be pulled low. A low state on terminal P3 will cause the power factor correction circuit to turn terminal P6 off and consequently keep transistor Q1 turned off When transistor Q1 is turned off none of the energy from inductor L3 is switched into the circuit to boost the magnitude of the DC voltage. The DC bulk voltage available to inverter transistors Q4 and Q5 is greatly lowered. The lower voltage when transferred across transformer T1 is of insufficient voltage and power to cause lamp B1 to overheat. Resistor R33 and capacitor C31 provide a time delay means for turning on transistor Q31. Capacitor C31 initially provides for a charge time to allow the protection circuit to be non-responsive during lamp start-up. When a lamp is first started, a high initial voltage is required to strike the arc. In order to prevent the protection circuit from detecting the starting voltage, a time delay is incorporated. The time delay allows the lamps to start without triggering the protection circuit. Using a 10 K ohm resistor R33 and 4.7 microfarad capacitor C31 gives a time constant of 43 milliseconds in conjunction with R31. After C31 initially discharges and turns off Q1, transistor Q31 will turn off, allowing transistor Q1 to turn on and the DC voltage to begin to rise again. Resistor R31 helps to discharge C31. With the defective lamp still in place, the power will rise to an excessive level and be detected. C31 will then charge up again and turn-on transistor Q31 which will turn off power factor correction switch Q1. This cycling action allows for periodic attempts to restart the lamp and resume normal operation once the defective lamp has been replaced.

The second failure mode sensed by the circuit of FIG. 2 is a rectifying lamp. If a lamp should start to rectify the AC current flowing through it, it will show a DC potential difference across the lamp. When this occurs, the lamp will require (draw) more power due to increased cathode fall. This increased power will be reflected in the primary winding of transformer T1 and also in the emitter currents at junction J1. This will be detected by protection circuit 30. Protection circuit 30 will then operate in the same mode as discussed previously for the overvoltage condition to reduce the power supplied to the lamp(s).

Figure 3:
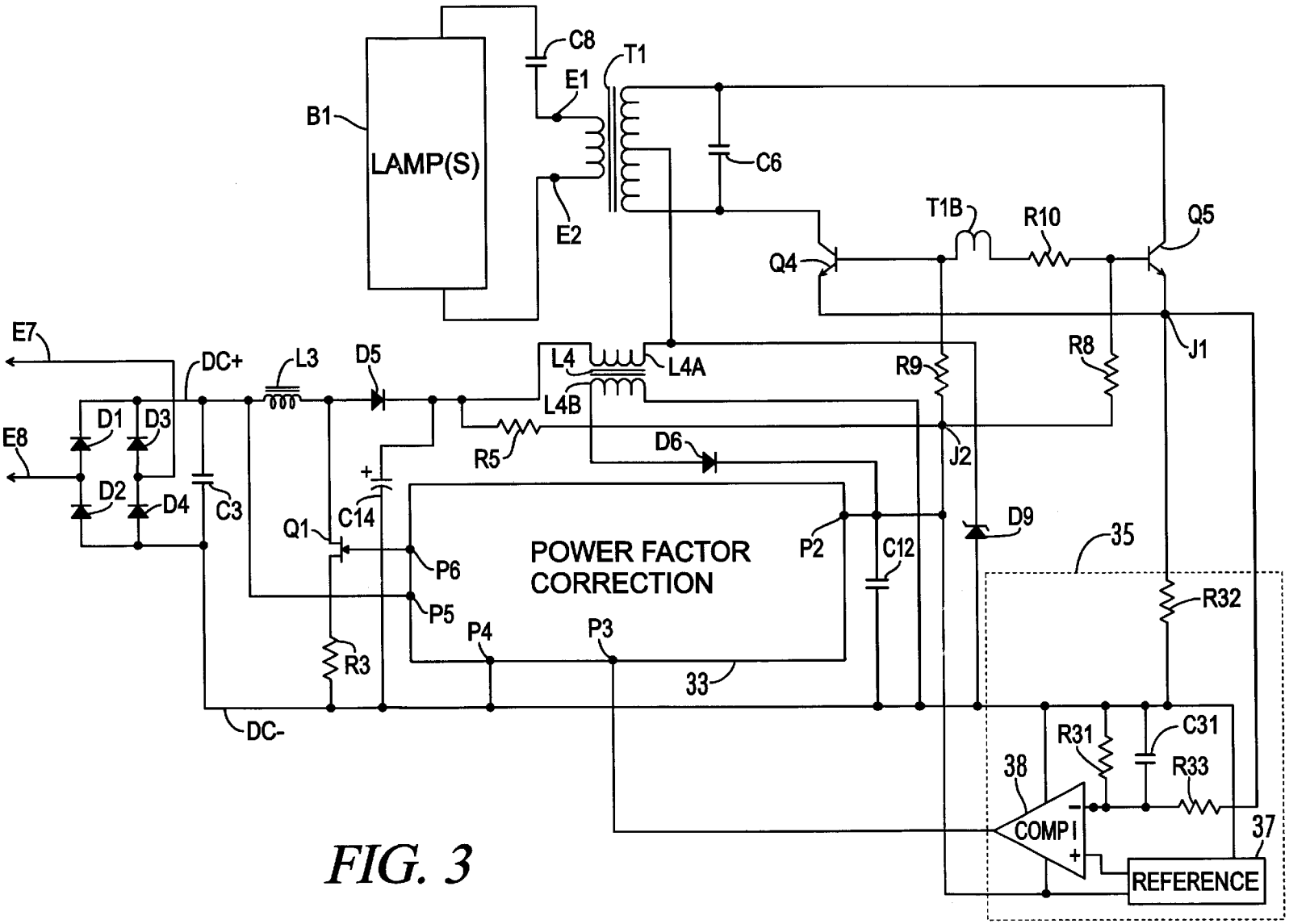
FIG. 3 is a schematic diagram of another embodiment of a Primary Side Lamp Protection Circuit for Isolated Ballasts Driving Gas Discharge Lamps that utilizes a comparator.

Referring to FIG. 3, another embodiment of a ballast and lamp protection circuit is shown. In the circuit of FIG. 3, all the components are identical to those shown and described in FIG. 2 except for the protection circuit 35 which is different.

Protection circuit 35 contains a comparator 38 such as a SGS TS372 and a voltage reference 37. Also included are a 10 K ohm resistor R33, a 3.9 ohm resistor R32, a 100 K ohm resistor R31 and a 4.7 micro farad capacitor C31. Resistor R32 is connected between the junction of the emitters of transistors Q4 and Q5 (junction J1) and the DC− line. Resistor R33 is connected between junction J1 and the negative input of comparator 38. Comparator 38 also has inputs connected to the DC− line and voltage reference 37. Comparator 38 has its output connected to terminal P3 of power factor correction circuit 33. Resistor R31 is connected between the DC− line and the negative input of comparator 38. Capacitor C31 is connected between the negative input of comparator 38 and the DC− line.

The operation of the protection circuit of FIG. 3 is as follows. The protection circuit 35 will sense the lamp overvoltage failure mode and the rectifying lamp failure mode. Both of these failure modes result in increased output wattage. The first condition sensed is when the lamp voltage rises above a setpoint while the lamp arc is ignited. The wattage developed in the primary winding of transformer T1 is proportional to the wattage appearing at the lamp. The voltage at the junction J1 of the emitters of transistor Q4 and Q5 with respect to the DC− buss will be proportional to the wattage developed in the primary of T1. Resistor R32 acts as the sensor means to sense this current and output a sensor signal. When the voltage at J1 goes high, it will appear at the negative terminal of comparator 38. This will be compared to voltage reference 37 causing comparator 38 to go high at its output. When comparator 38 goes high, terminal P3 of the converter will be pulled low. Here comparator 38 is the control means with its control input terminal being the negative input pin and its control output terminal being the output pin. A low state on terminal P3 will cause the power factor correction circuit to turn terminal P6 off and consequently keep transistor Q1 turned off. When transistor Q1 is turned off, none of the energy from inductor L3 is switched into the circuit to boost the magnitude of the DC voltage. The DC voltage available to inverter transistors Q4 and Q5 is greatly lowered. The lower voltage when transferred across transformer T1 is insufficient power to cause lamps B1 to overheat. Resistor R33 and capacitor C31 provide a time delay means for turning on comparator 38. Capacitor C31 initially provides for a charge time to allow the protection circuit to be non-responsive to the increased lamp voltage required during lamp starting. Using a 10 K ohm resistor R33 and a 4.7 microfarad capacitor C31 gives a time constant of 43 milliseconds. After C31 initially discharges and turns off Q1, the comparator will turn off allowing transistor Q1 to turn on and the DC voltage to begin to rise again. Resistor R31 helps to discharge C31. With the defective lamp still in place, the power will rise to an excessive level and be detected. C31 will then charge up again and tum-on comparator 38 which will turn off power factor correction switch Q1. This cycling action allows for periodic attempts to restart the lamp and resume normal operation once the defective lamp has been replaced.

The second failure mode sensed by the circuit is a rectifying lamp. If a lamp should start to rectify the AC current flowing through it, it will show a DC potential difference across the lamp. When this occurs, the lamp will require (draw) more power due to increased cathode fall. This increased power will be reflected in the primary winding of transformer T1 and also in the emitter currents at junction J1. This will be detected by protection circuit 35. Protection circuit 35 will then operate in the same mode as discussed previously for the overvoltage condition to reduce the power supplied to the lamp(s).

Figure 4:
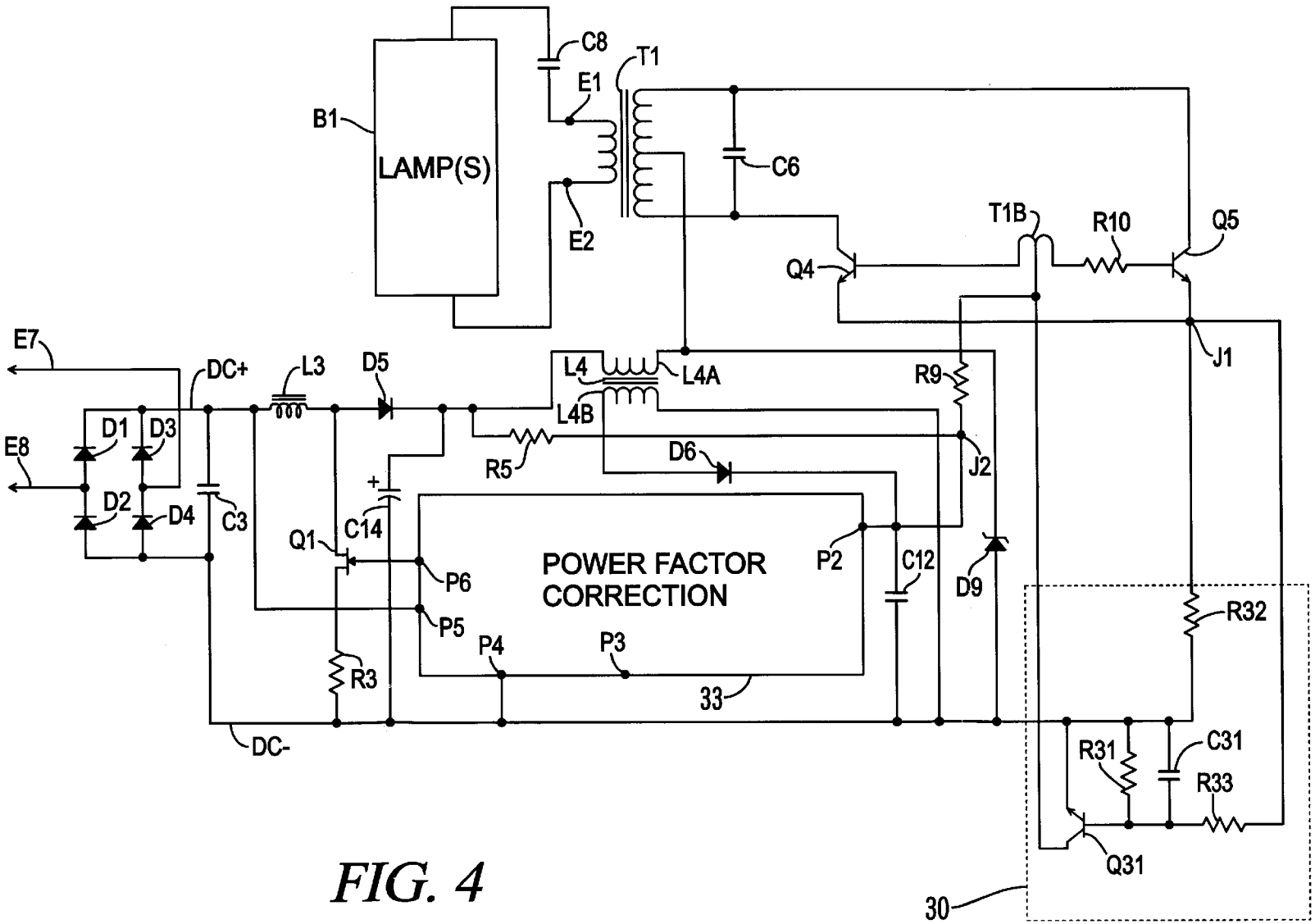
FIG. 4 is a schematic diagram of another embodiment of a Primary Side Lamp Protection Circuit for Isolated Ballasts Driving Gas Discharge Lamps that connects directly to the inverter.

Referring to FIG. 4, another embodiment of a ballast and lamp protection circuit is shown. The circuit of FIG. 4 is similar to FIG. 2. In FIG. 4, the failure sensing circuit is connected to the inverter instead of to the power factor correction circuit. The changes include having the collector of transistor Q31 connected to the center tap of transformer winding T1B. Resistor R8 is eliminated and resistor R9 is connected between Junction J2 and the T1B center tap connection for biasing purposes. In this configuration, the transistors required would need to be high gain transistors. To use the same transistor as in the other embodiments, the values of R31, R33 and C31 need to be changed. R31 is now a 5 K ohm resistor. R33 is a 500 ohm resistor and C31 is a 100 uF capacitor. The resulting time constant is 45 milliseconds. The rest of the circuit is identical to that shown and described in FIG. 2.

The operation of the protection circuit of FIG. 4 is as follows. The protection circuit 30 will sense the lamp overvoltage failure mode and the rectifying lamp failure mode. The first condition sensed is when the lamp voltage rises above a setpoint while the lamp arc is ignited. The power level on the primary winding of transformer T1 is proportional to the output power appearing at the lamp. Since the ballasting capacitor C8 delivers an approximately constant current to the load, any increase in load voltage will result in an increase in load power. The load power will be reflected across the primary of T1. Similarly, the primary voltage of T1 is fixed by the magnitude of the DC voltage across the bulk capacitor C14. Therefore, an increase in load power will result in an increase in current drawn by transistors Q4 and Q5. The voltage at the junction J1 of the emitters of transistor Q4 and Q5 with respect to the DC– buss will be proportional to the reflected power from the lamp with a constant bulk voltage. Resistor R32 acts as the sensor means to sense this current. Alternatively, the power level could be sensed directly from the primary winding of T1. When the voltage at J1 goes high, resistor R32 will cause transistor Q31 to be properly biased to turn on. Here transistor Q31 is the control means with its control input terminal being the base and its control output terminal being the collector. When transistor Q31 turns on, winding T1B will be pulled low. A low state on winding T1B will cause the inverter circuit of transistors Q4 and QS to reduce its output power. The lower voltage when transferred across transformer T1 is of insufficient voltage and power to cause lamp B1 to overheat. Resistor R33 and capacitor C31 again provide a time delay means.

The second failure mode sensed by the circuit of FIG. 4 is a rectifying lamp. If a lamp should start to rectify the AC current flowing through it, it will show a DC potential difference across the lamp. When this occurs, the lamp will require (draw) more power due to increased cathode fall. This increased power will be reflected in the primary winding of transformer T1 and also in the emitter currents at junction J1. This will be detected by protection circuit 30. Protection circuit 30 will then operate in the same mode as discussed previously for the overvoltage condition to reduce the power supplied to the lamp(s).

Figure 5:
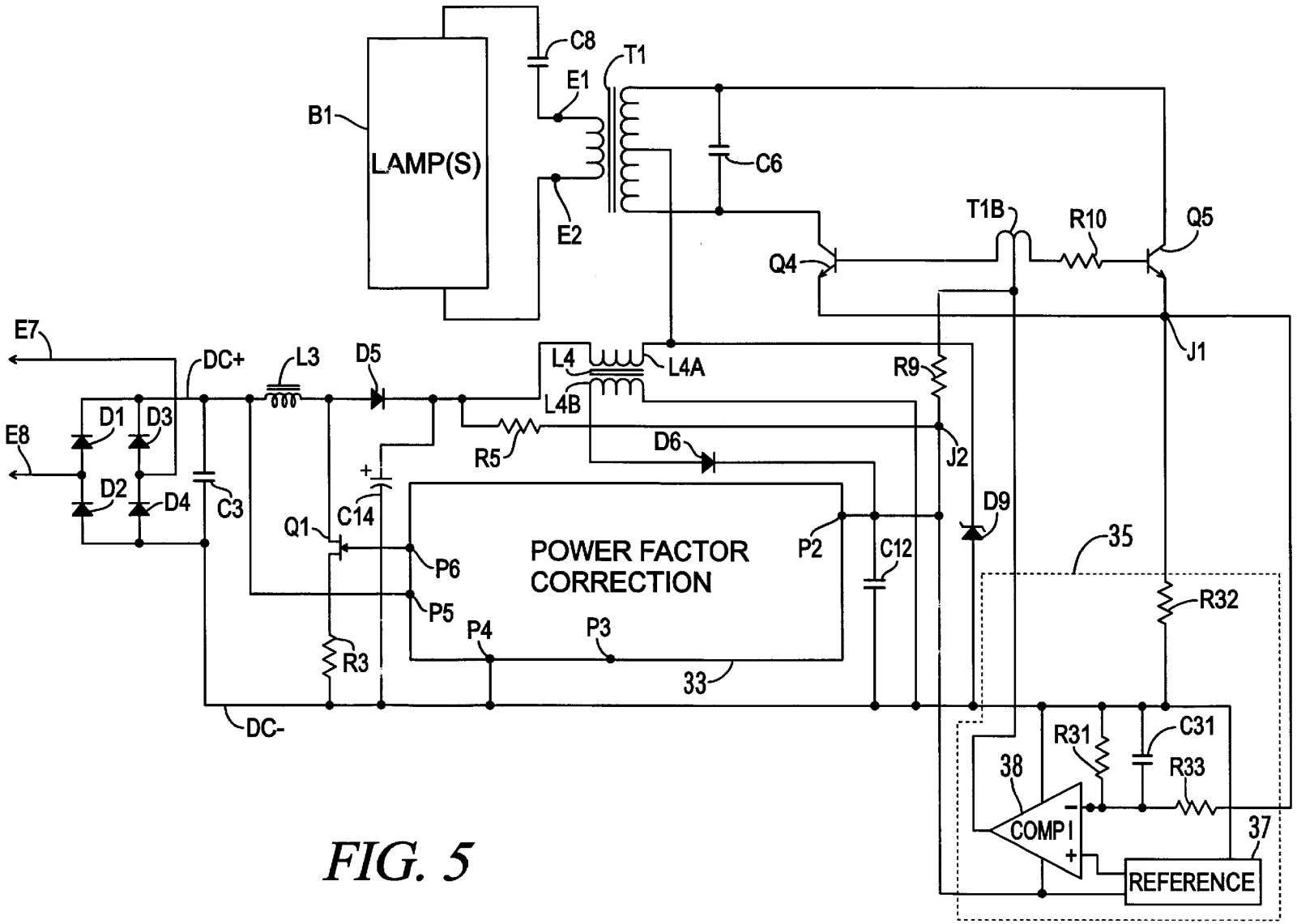
FIG. 5 is a schematic diagram of another embodiment of a Primary Side Lamp Protection Circuit for Isolated Ballasts Driving Gas Discharge Lamps that connects directly to the inverter which utilizes a comparator.

Referring to FIG. 5, another embodiment of a ballast and lamp protection circuit is shown. The circuit of FIG. 5 is similar to FIG. 3. In FIG. 5, the failure sensing circuit is connected to the inverter instead of to the power factor correction circuit. The changes include having the collector of transistor Q31 connected to the center tap of transformer winding T1B. Resistor R8 is eliminated and resistor R9 is connected between Junction J2 and the T1B center tap connection for biasing purposes. The rest of the circuit is identical to that shown and described in FIG. 3.

The operation of the protection circuit of FIG. 5 is as follows. The protection circuit 35 will sense the lamp overvoltage failure mode and the rectifying lamp failure mode. Both of these failure modes result in increased output wattage. The first condition sensed is when the lamp voltage rises above a setpoint while the lamp arc is ignited. The wattage developed in the primary winding of transformer T1 is proportional to the wattage appearing at the lamp. The voltage at the junction J1 of the emitters of transistor Q4 and Q5, with respect to the DC– buss, will be proportional to the wattage developed in the primary of T1. Resistor R32 acts as the sensor means to sense this current. When the voltage at J1 goes high, it will appear at the negative terminal of comparator 38. This will be compared to voltage reference 37 causing 38 to go high at its output. Here comparator 38 is the control means with its control input terminal being the negative input pin and its control output terminal being the output pin. When comparator 38 goes high, winding T1B will be pulled low. A low state on winding T1B will cause the inverter current and voltage to be reduced. The lower voltage when transferred across transformer T1 is of insufficient power to cause lamps B1 to overheat. Resistor R33 and capacitor C31 again provide a time delay means The second failure mode sensed by the circuit is a rectifying lamp. If a lamp should start to rectify the AC current flowing through it, it will show a DC potential difference across the lamp. When this occurs, the lamp will require (draw) more power due to increased cathode fall.

This increased power will be reflected in the primary winding of transformer T1 and also in the emitter currents at junction J1. This will be detected by protection circuit 35. Protection circuit 35 will then operate in the same mode as discussed previously for the overvoltage condition to reduce the power supplied to the lamp(s).

The present invention has been described in connection with a preferred embodiment. It will be understood that many modifications and variations will be readily apparent to those of ordinary skill in the art without departing from the spirit or scope of the invention and that the invention is not to be taken as limited to all of the details herein. Therefore, it is manifestly intended that this invention be limited only by the claims and the equivalents thereof

What is claimed is:

1. A protection circuit for at least one gas discharge lamp, the protection circuit sensing at least one failure mode in the lamp(s) and providing a control signal to a ballast circuit powering the lamp(s) to reduce power being supplied to the lamp(s) to prevent overheating of the lamp(s) comprising:

a sensor means for detecting the failure mode(s) in the lamp(s), the sensor means providing a sensor signal proportional to the lamp(s) power;

a control means coupled to the sensor means, the control means having a control input terminal for receiving the sensor signal and a control output terminal, the control means providing the control signal at the output terminal in response to the sensor means detecting said failure mode;

a boost converter connected to the control means output terminal, the boost converter operable to receive the control signal such that upon receipt of the control signal power to the lamp(s) is reduced to prevent overheating of the lamp(s); and a time delay means, The time delay means connected to the control means such that the control means is unresponsive during starting of the lamp(s).

2. The protection circuit according to claim 1 in which the boost converter comprises:

a power factor correction circuit;

a power factor correction switch;

a boost inductor; and a diode.

3. The protection circuit according to claim 1 in which the control means is a transistor.

4. The protection circuit according to claim 1 in which the control means is a comparator.

5. The protection circuit according to claim 1 in which the sensor means is a resistor.

6. The protection circuit according to claim 1 in which the sensor means is connected to an inverter.

7. The protection circuit according to claim 1 in which the sensor means is connected to a primary side of an output transformer.

8. The protection circuit according to claim 1 in which the failure mode(s) sensed is an overvoltage condition in the lamp(s).

9. The protection circuit according to claim 1 in which the failure mode(s) sensed is an overvoltage condition in the lamp(s).

10. The protection circuit according to claim 1 in which the protection circuit and the ballast circuit are an integrated assembly.

11. The protection circuit according to claim 1 in which the time delay means comprises: a resistor, and a capacitor.

12. A protection circuit for at least one gas discharge lamp, the protection circuit sensing at least one failure mode in the lamp(s) and providing a control signal to a ballast circuit powering the lamp(s) to reduce power being supplied to the lamp(s) to prevent overheating of the lamp(s) comprising:

a sensor means for detecting the failure mode(s) in the lamp(s), the sensor means providing a sensor signal proportional to the lamp(s) power;

a control means coupled to the sensor means, the control means having a control input terminal for receiving the sensor signal and a control output terminal, the control means providing the control signal at the output terminal in response to the sensor means detecting said failure mode;

an inverter connected to the control means output terminal, the inverter operable to receive the control signal such that upon receipt of the control signal power to the lamp(s) is reduced to prevent overheating of the lamp(s);

a transformer connected between the inverter and the lamp(s) and adapted to provide a primary side for the protection circuit and an output side operatively connected to the lamp(s), the sensor means operatively connected on the primary side of the transformer to provide isolated sensing of the power to the lamp(s); and a time delay means, the time delay means connected to the control means such that the control means is unresponsive during starting of the lamp(s).

13. The protection circuit according to claim 12 which the control means is a transistor.

14. A protection circuit for at least one gas discharge lamp, the protection circuit sensing at least one failure mode in the lamp(s) and providing a control signal to a ballast circuit powering the lamp(s) to reduce power being supplied to the lamp(s) to prevent overheating of the lamp(s) comprising:

a sensor means for detecting the failure mode(s) in the lamp(s), the sensor means providing a sensor signal proportional to the lamp(s) power:

a control means coupled to the sensor means, the control means having a control input terminal for receiving the sensor signal and a control output terminal, the control means providing the control signal at the output terminal in response to the sensor means detecting said failure mode, wherein the control means is a comparator;

an inverter connected to the control means output terminal, the inverter operable to receive the control signal such that upon receipt of the control signal power to the lamp(s) is reduced to prevent overheating of the lamp(s); and a time delay means, the time delay means connected to the control means such that the control means is unresponsive during starting of the lamp(s).

15. A protection circuit for at least one gas discharge lamp, the protection circuit sensing at least one failure mode in the lamp(s) and providing a control signal to a ballast circuit powering the lamp(s) to reduce power being supplied to the lamp(s) to prevent overheating of the lamp(s) comprising:

a transistor, the transistor having a base, an emitter and a collector;

a first resistor connected between an inverter to and the base;

a second resistor connected between the inverter teal and the emitter;

a capacitor connected between the emitter and the base, a third resistor connected between the emitter and the base;

the collector connected to a power factor correction circuit;

the power factor correction circuit connected to a power factor correction switch;

the first resistor sensing the failure mode(s) and switching the transistor from an off state to an on state causing the power factor correction circuit to turn off the power factor correction switch such that power to the lamp(s) is reduced.

16. The protection circuit according to claim 15 in which the protection circuit and the ballast circuit are an integrated assembly.

17. A method for protecting at least one gas discharge lamp from at least one failure mode, the method providing a control signal to a ballast circuit powering the lamp(s) to reduce power being supplied to the lamp(s) to prevent overheating of the lamp(s) comprising the steps of:

(a) detecting the lamp(s) failure modes(s);

(b) generating the control signal in response to detecting the failure mode(s);

(c) coupling the control signal to a boost converter;

(d) reducing power to the lamp(s) such that over heating is prevented;

(e) delaying the control signal during starting of the lamp(s).

18. A method for protecting at least one gas discharge lamp from at least one failure mode, the method providing a control signal to a ballast circuit powering the lamp(s) to reduce power being supplied to the lamp(s) to prevent overheating of the lamp(s), the method comprising the steps of:

(a) providing at least one transformer in the ballast circuit, the transformer including at least a primary side and an output side;

(b) detecting the lamp(s) failure mode(s) from the primary side of the transformer;

(c) generating the control signal in response to detecting the failure mode(s);

(d) coupling the control signal to an inverter;

(e) reducing power to the lamp(s) such that over heating is prevented;

(f) delaying the control signal during starting of the lamp(s).

19. A ballast and lamp protection circuit for at least one gas discharge lamp, the circuit comprising:

a load driving circuit for providing a load power, wherein the load power is characterized by both a normal power mode and failure mode(s), a sensor means providing a sensor signal proportional to the load power;

a control means coupled to the sensor means, the control means having a control input terminal for receiving the sensor signal and a control output terminal, the control means providing a control signal at the output terminal in response to the sensor means detecting the failure mode(s);

a boost converter connected to the control means output terminal, the boost converter operable to receive the control signal and reduce the load power;

a time delay means, the time delay means connected to the control means such that the control means is unresponsive during starting of the lamp(s);

wherein the control means and the boost converter only operate to reduce the load power during the failure mode(s).

* * * * *